US007004334B2

(12) United States Patent
Walsh et al.

(10) Patent No.: US 7,004,334 B2
(45) Date of Patent: Feb. 28, 2006

(54) DISPLAY SHELF

(75) Inventors: Desmond M. Walsh, Stamford, CT (US); Richard J. Fellinger, Franklin Lakes, NJ (US)

(73) Assignee: Mechtronics Corporation, White Plains, NY (US)

( * ) Notice: Subject to any disclaimer, the term of this patent is extended or adjusted under 35 U.S.C. 154(b) by 0 days.

(21) Appl. No.: 10/422,274

(22) Filed: Apr. 24, 2003

(65) Prior Publication Data

US 2004/0055981 A1 Mar. 25, 2004

Related U.S. Application Data

(60) Provisional application No. 60/375,483, filed on Apr. 24, 2002.

(51) Int. Cl.
*A47F 7/00* (2006.01)

(52) U.S. Cl. ..... 211/88.01; 211/75; 211/90.01; 248/206.4

(58) Field of Classification Search ..... 211/88.01, 211/75, 87.01, 184, 74, 71.01, 85.18, 85.23, 211/90.01; 248/206.3
See application file for complete search history.

(56) References Cited

U.S. PATENT DOCUMENTS

| | | | | | |
|---|---|---|---|---|---|
| 3,220,558 | A | * | 11/1965 | Olsson | 211/74 |
| 3,893,739 | A | | 7/1975 | Bernard | 312/138 |
| 4,479,584 | A | | 10/1984 | Raz | 211/89 |
| 4,560,072 | A | * | 12/1985 | Burrell | 211/75 |
| 4,984,693 | A | * | 1/1991 | Belokin et al. | 211/88.01 |
| 5,096,272 | A | | 3/1992 | Belokin, Jr. et al. | 312/129 |
| 5,486,044 | A | * | 1/1996 | Bennett | 312/321.5 |
| 5,567,029 | A | | 10/1996 | Haenisch et al. | 312/405.1 |
| 5,913,433 | A | | 6/1999 | Belokin et al. | 211/90.01 |
| 6,119,876 | A | | 9/2000 | Lacourse | 211/74 |
| 6,571,967 | B1 | * | 6/2003 | Belokin et al. | 211/71.01 |

* cited by examiner

*Primary Examiner*—Robert W Gibson, Jr.
(74) *Attorney, Agent, or Firm*—Wiggins and Dana LLP; Anthony P. Gangemi; Dale L. Carlson

(57) ABSTRACT

A bottle glorifier may be mounted on the interior surface of a glass refrigerator case door. A body holds a side-to-side array of exemplary containers. A separate adapter accommodates particular sizes or combinations of sizes of containers for a given body.

19 Claims, 5 Drawing Sheets

SECTION A–A

DISPLAY SHELF

CROSS-REFERENCE TO RELATED APPLICATIONS

This patent application claims the benefit of U.S. Provisional Patent Application Ser. No. 60/375,483, entitled "GLORIFIER" that was filed on Apr. 24, 2002, the disclosure of which is incorporated by reference in its entirety as if fully set forth herein.

BACKGROUND OF THE INVENTION

1. Field of the Invention

This invention relates to retail displays, and more particularly to the display of beverage containers in refrigerator cases.

2. Description of the Related Art

In the retail environment, beverages are often sold from refrigerator cases. The beverages are typically carried in front to back columns on shelves or shelf glides. This positioning is often less than optimal from the point of view of consumer visibility as relatively far from the hinged or sliding glass door of the case. It is accordingly advantageous to provide some form of rack or glorifier more prominently displaying representative beverage containers (either full or empty). The rack may advantageously be mounted on the interior surface of the glass door so as to be visible through the door. This greatly enhances visibility to the consumer. Because the door is subject to repeated opening and closing, the glorifier must sufficiently retain the containers.

BRIEF SUMMARY OF THE INVENTION

A display device is advantageously mounted on the interior surface of a transparent refrigerator case door. The device advantageously holds a side-by-side array of containers. The device also advantageously includes a signage-carrying area. To accommodate the possibility of displaying different containers, the display advantageously includes a main body which may be used to display a variety of sizes of containers (e.g. a variety of characteristic cross-sectional diameters for cans, bottles, and the like). For any particular such size or range of such sizes, there advantageously is provided a corresponding adapter which may be removably installed to the body to maintain the array of the corresponding size (and number) of containers.

An advantageous signage carrier is unitarily molded with the main body below a floor portion thereof and is at an angle off vertical to improve viewability by a consumer looking downward through the door at the signage.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION OF THE PREFERRED EMBODIMENTS

Figure 1:
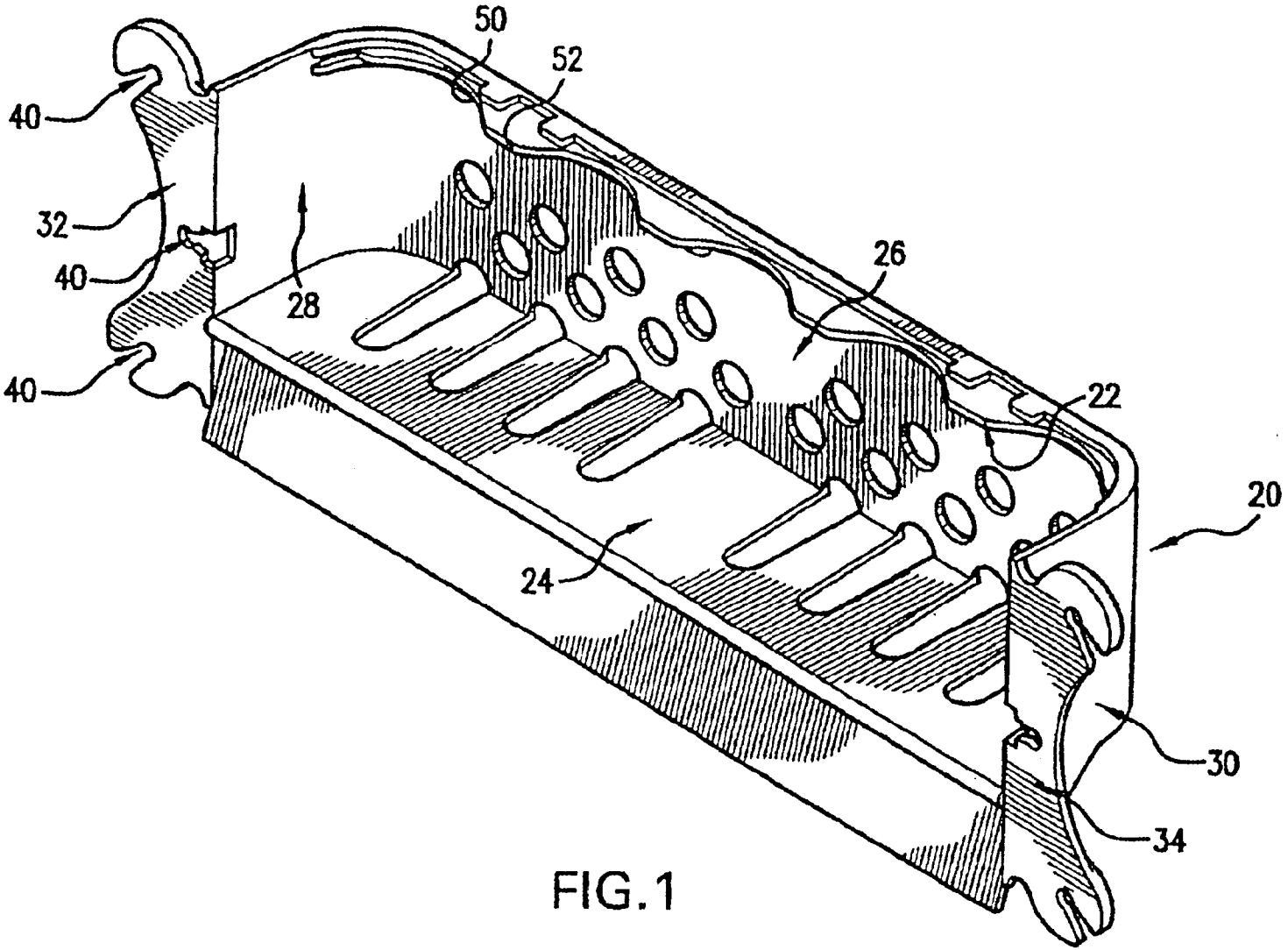
FIG. 1 is a view of an assembled display body and adapter.

FIG. 1 shows an assembly of a display body 20 and adapter plate 22. The body 20 and adapter plate 22 advantageously each consist essentially of unitary moldings of plastic material (e.g., polyethylene terephthalate glycol (PET-G)). The material is advantageously transparent and untinted. In another embodiment, the material is tinted or colored for example to suit a particular branded scheme or to improve visibility.

The body 20 includes a lower wall or floor portion 24, a front wall portion 26 and left and right sidewall portions 28 and 30. Along rear edges of the sidewalls 28 and 30, associated left and right ears 32 and 34 extend laterally outward and have front and rear surfaces. The ears 32 and 34 each include a number of apertures 40 for receiving root ends of suction cups (not shown) for mounting the display to an interior surface of a glass wall of a refrigerator case door (also not shown). It should be appreciated that other means for mounting the display may be employed, for example, a hook, hanger or the like that extends down from a top portion of the refrigerator case door such that the display retains its location adjacent the interior surface of the glass wall.

When so mounted, the rear surfaces of the ears 32 and 34 are in close facing relationship to the door interior surface. The floor 24, front wall 26 and sidewalls 28 and 30 cooperate with the door to define an upwardly open compartment for receiving a side-by-side array of containers (not shown).

Figure 2:
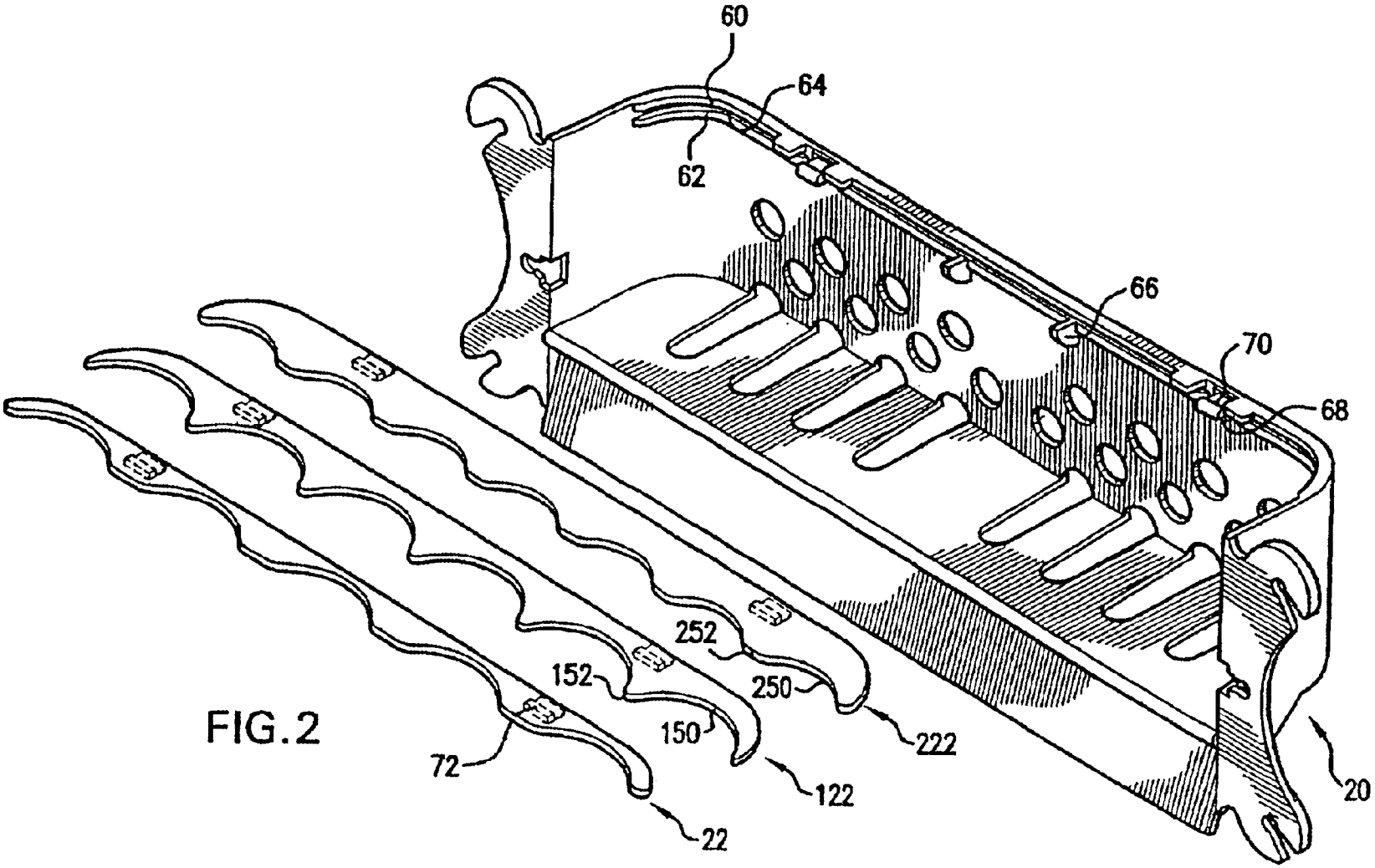
FIG. 2 is a view of a display body and interchangeable adapters.

The exemplary adapter plate 22 extends rearward from a location proximate the upper edge of the front wall 26. The a rear edge of the adapter plate 22 has a number of alternating concave surface portions 50 separated by convex surface portions 52. The exemplary adapter plate 22 has five such concave areas for accommodating an array of five containers. Containers of different sizes may be displayed. If the container diameter is sufficiently smaller than the exemplary five, more containers may be placed in the array. For example, FIG. 2 shows two alternate adapter plates 122 and 222 having concave areas 150 and 250 respectively separated by convex areas 152 and 252, for accommodating arrays of six and seven containers, respectively. These concave and convex areas are at proportionately smaller pitch than those of the adapter plate 22. For such smaller containers, the adapter plate 22 is also proportionally deeper (e.g., having a greater span between the adapter front edge and the convex areas and thus the front wall inner surface and containers). This keeps the containers close to or against the door interior surface.

For mounting the appropriate adapter plate 22, 122 or 222 to the body 20, the body and adapter plates are advantageously provided with complementary mounting features. In the exemplary embodiment along the upper edge of the body front wall and a transition to the sidewall, there is an inwardly directed upper retaining rib 60. Therebelow and spaced apart by a distance substantially the same as the adapter thickness is a lower rib 62 with a channel 64 for receiving a front edge portion of the adapter plate (e.g., adapter plates 22, 122 and 222) therebetween. To further support the adapter plate, one or more braces 66 may extend back from the interior surface of the front wall and having upper surfaces coplanar with upper surfaces of the lower rib for supporting the adapter plate's underside. To positively retain the adapter plate, one or more catches 68 having upwardly directed barbs 70 may extend aft from the front wall. The barbs 70 may be received in complementary compartments 72 extending blindly upward from the underside of the adapter plates.

Figure 3:
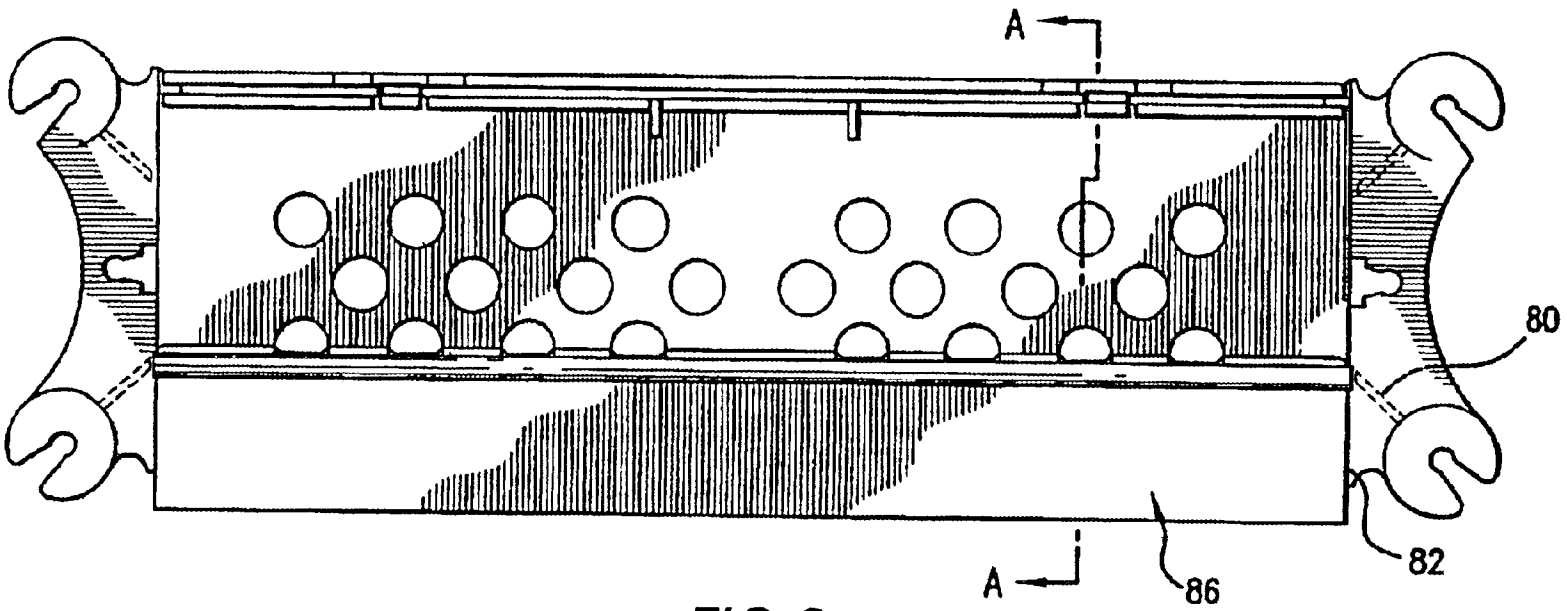
FIG. 3 is a rear view of the assembled body and adapter of FIG. 1.
Figure 4:
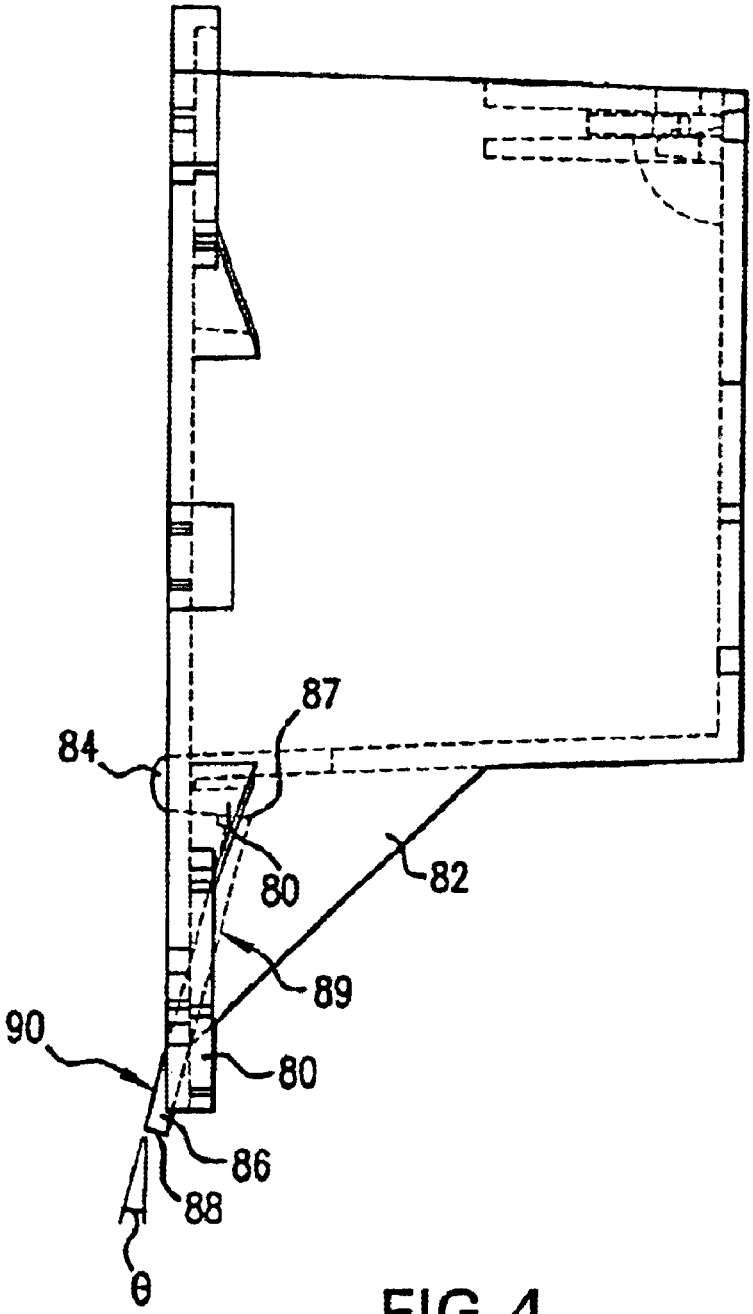
FIG. 4 is a side view of the body and adapter of FIG. 3.
Figure 5:
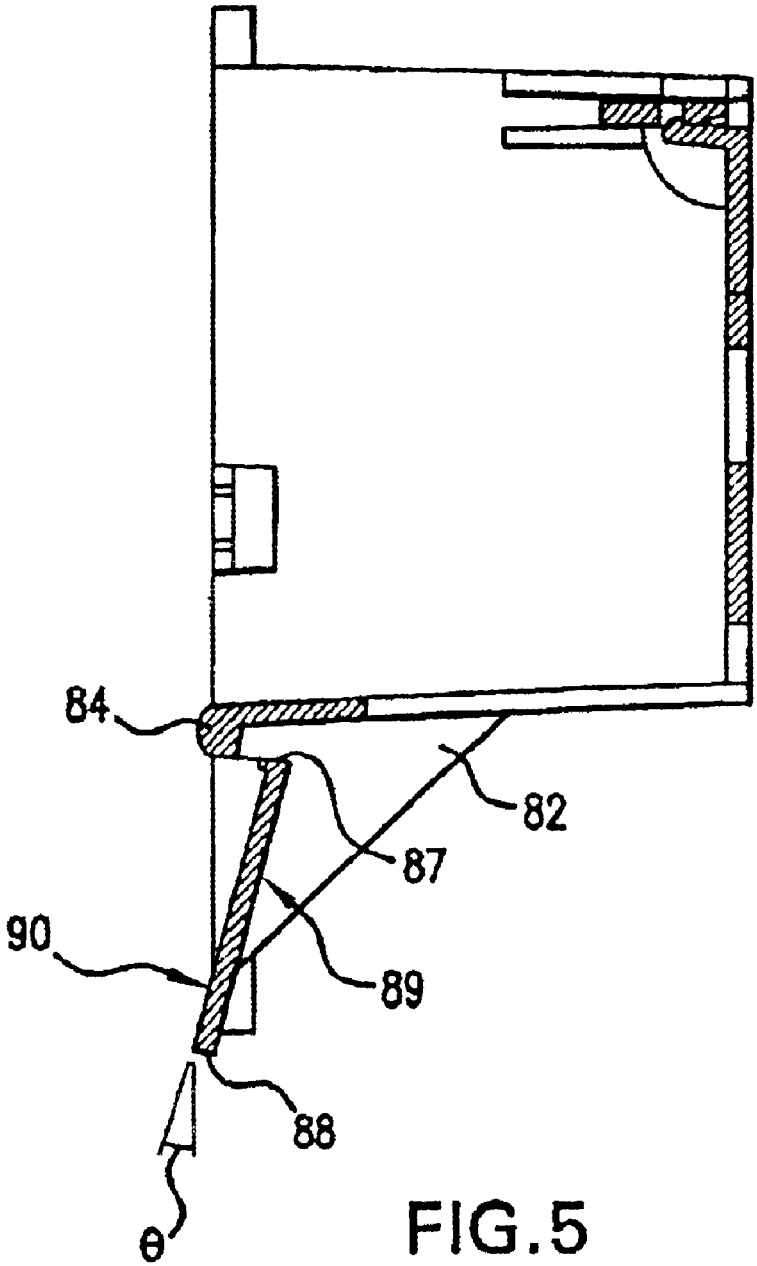
FIG. 5 is a side sectional view of the body and adapter of FIG. 3.

For enhanced structural integrity, the ears 32 and 34 may be provided with bracing rib structures 80 for example along their front surfaces (FIGS. 3 and 4). A gusset 82 may connect a lower edge of each sidewall with a lower portion of each associated ear 32 and 34 for further strengthening of the ear. FIG. 4 also shows the floor 24 terminating at a rear edge defined by a convex or bullnose protruberance 84 projecting rearward of the rear surface of the ears 32 and 34. A signage carrier 86 extends transversely between the gussets 82 and has upper and lower edges 87 and 88 and front and rear surfaces 89 and 90. At least the rear surface 90 is advantageously at an angle θ (e.g., about 5–30°) off vertical so that the side 90 faces slightly upward to permit graphics thereon (not shown) to be more readily viewed by a consumer through the door with a reduced distortion. For further improved viewing, a lower portion of the signage carrier 86 protrudes rearward of the ear rear surfaces to be in extremely close, if not contacting, proximity with the door interior surface.

One or more embodiments of the present invention have been described. Nevertheless, it will be understood that various modifications may be made without departing from the spirit and scope of the invention. For example, the needs of particular uses may influence construction. Various ornamental or additional functional details maybe incorporated. In one group of alternate embodiments, the signage carrier may join the floor. For example, the floor may terminate at the signage carrier well ahead of the plane defined by the ear rear surfaces. Accordingly, other embodiments are within the scope of the following claims.

What is claimed is:

1. A display device in combination with a plurality of first and second containers, the device comprising:

a first unitary molding comprising:

a generally transverse floor;

a generally vertical forward wall having upper and lower extremities;

left and right sidewall cooperating with the floor and forward wall to define a compartment holding the containers in a side-to-side array; and left and right generally vertical ears;

a primary adapter being removably installed to and extending rearward from the forward wall, wherein the primary adapter has a rearward surface with first portions protruding rearward of second portions, the first portions restraining lateral movement of adjacent ones of the first containers;

a secondary adapter being removably installable to and extending rearward from the forward wall, wherein the secondary adapter has a rearward surface with first portions protruding rearward of second portions and at a second pitch different than a first pitch of the first portions of the primary adapter, the first portions of the secondary adapter restraining lateral movements of adjacent ones of the second containers; and a plurality of suction cups carried by said ears for securing the device to a mounting surface.

2. The device of claim 1 wherein the primary and secondary adapters are removable nondestructively of the first unitary molding.

3. The device of claim 1 wherein the primary and secondary adapters each consist essentially of a second unitary molding.

4. The device of claim 1 in combination with a transparent wall of a refrigerator case door providing the mounting surface to which the device is attached.

5. The device of claim 4 wherein the first unitary molding is transparent.

6. The device of claim 1 wherein the first and second portions of the primary and secondary adapters are comprised of a plurality of alternating concave surface portions separated by convex surface portions and the concave and convex surface area portions of the secondary adapter are at a proportionally smaller pitch than those of the primary adapter.

7. The device of claim 1, further including:

an inwardly directed upper retaining rib located along the upper extremity of the forward wall and transitions to the left and right sidewalls; and a lower retaining rib spaced below and apart from the upper retaining rib a distance substantially the same as a thickness of the primary and secondary adapters;

wherein the space between the upper and lower retaining ribs defines a channel for receiving a front edge portion of each of the primary and secondary adapters.

8. The device of claim 7, further including:

a plurality of braces extending rearward from an interior surface of the forward wall, the plurality of braces having upper surfaces coplanar with upper surfaces of the lower retaining rib for supporting a lower surface of the primary and secondary adapters.

9. The device of claim 7, further including:

a plurality of catches having upwardly directed barbs extending rearward from the forward, wherein the barbs are received in complementary compartments extending blindly upward from a lower surface of the primary and secondary adapters.

10. A display device in combination with a plurality of containers, the device comprising:

a unitary molding comprising:

a generally transverse floor;

a generally vertical forward wall having upper and lower extremities;

left and right sidewall cooperating with the floor and forward wall to define a compartment holding the containers in a side-to-side array;

left and right generally vertical ears; and a signage carrier extending transversely below the floor, wherein the signage carrier has a major plate portion extending at an angle of between 5 and 30 degrees off vertical;

an adapter having a removable installed condition extending rearward from the forward wall; and a plurality of suction cups carried by said ears for securing the device to a mounting surface.

11. A device comprising:

a body comprising:

a generally transverse floor;

a generally vertical forward wall having upper and lower extremities;

left and right sidewall cooperating with the floor and forward wall to define a compartment for holding a plurality of first and second containers in a side-to-side array; and left and right generally vertical ears; and a plurality of suction cups carried by said ears for securing the device to a mounting surface, wherein:

the device further comprises;

a primary adapter having means for restraining lateral movement of adjacent ones of the first containers;

a secondary adapter having means for retaining lateral movement of adjacent ones of the second containers, wherein the means of the secondary adapter are at a second pitch different than a first pitch of the means of the primary adapter; and the body further comprises means for removeably securing each of the primary and secondary adapters in an installed condition extending rearward from the forward wall.

12. The device of claim 11 wherein the body further comprises means for carrying signage below the floor.

13. The device of claim 12 wherein the body consists essentially of a unitary plastic molding.

14. A method for using a display device in combination with a plurality of containers, the device comprising:

a unitary molding comprising:

a generally transverse floor;

a generally vertical forward wall having upper and lower extremities;

left and right sidewall cooperating with the floor and forward wall to define a compartment holding the containers in a side-to-side array; and left and right generally vertical ears;

an adapter having a removable installed condition extending rearward from the forward wall; and a plurality of suction cups carried by said ears for securing the device to a mounting surface;

wherein the adapter is a first adapter and the plurality of containers is a plurality of first containers, the method comprising:

removing the plurality of first containers;

removing the first adapter from its installed condition;

installing a second adapter in place of the first adapter, the second adapter having first portions protruding rearward of second portions and at a second pitch different than a pitch of the first portions of the first adapter; and loading a plurality of second containers into the compartment in a side-to-side array, the second containers having transverse dimensions effective to be retained by the second adapter.

15. The method of claim 14 wherein:

the first and second containers are beverage containers.

16. The method of claim 14 further comprising:

removing the device from the mounting surface before removing the first adapter; and securing the device back to the mounting surface after installing the second adapter.

17. A display device in combination with a plurality of containers, the device comprising:

a unitary molding comprising:

a generally transverse floor;

a generally vertical forward wall having upper and lower extremities;

left and right sidewall cooperating with the floor and forward wall to define a compartment holding the containers in a side-to-side array;

left and right generally vertical ears; and a signage carrier extending transversely below the floor, wherein the signage carrier has a major plate position extending at an angle off vertical;

an adapter having a removable installed condition extending rearward from the forward wall; and a plurality of suction cups carried by said ears for securing the device to a mounting surface.

18. The device of claim 17 in combination with a transparent wall of a refrigerator case door providing the mounting surface to which the device is attached.

19. The device of claim 17 wherein the major plate portion extends at an angle of between 5 and 30 degrees off vertical.

* * * * *